US005215454A

United States Patent [19]

Ferramola et al.

[11] Patent Number: 5,215,454

[45] Date of Patent: Jun. 1, 1993

[54] BUZZ SUPPRESSION IN BURNERS OF HIGH CAPACITY DIRECT FIRED FLUID HEATERS

[75] Inventors: Gabriel D. Ferramola, Long Beach; Eugene B. Zwick, Huntington Beach; Joseph M. Prawdzik, Irvine; William D. Brigham, Huntington Beach, all of Calif.

[73] Assignee: Zwick Energy Research Organization, Inc., Huntington Beach, Calif.

[21] Appl. No.: 749,748

[22] Filed: Aug. 26, 1991

[51] Int. Cl.[5] ..... F23D 13/12

[52] U.S. Cl. ..... 431/2; 431/114; 431/183; 431/352

[58] Field of Search ..... 431/2, 114, 350, 354, 431/174, 183, 352

[56] References Cited

U.S. PATENT DOCUMENTS

| | | | |
|---|---|---|---|
| 3,144,897 | 8/1964 | Biber et al. | 431/114 |
| 3,934,574 | 1/1976 | Johnson | 431/114 |
| 3,940,234 | 2/1976 | Reed et al. | 431/114 |
| 4,374,637 | 2/1983 | Zwick et al. | 431/183 |

FOREIGN PATENT DOCUMENTS

| | | | |
|---|---|---|---|
| 998821 | 7/1965 | United Kingdom | 431/114 |

*Primary Examiner*—James C. Yeung
*Attorney, Agent, or Firm*—Beehler & Pavitt

[57] ABSTRACT

In direct fired fluid burner heater of the type where fuel is continuously injected and burned at one end of a cylindrical combustion chamber and combustion gases discharged at an opposite open end pass through a heat exchanger for heating a circulating medium, and where high heat capacity is achieved for a given chamber size by swirling the flame in the combustion chamber, acoustical low frequency buzzing is controlled by restricting the discharge area through which exhaust gases flow downstream of the heat exchanger.

15 Claims, 2 Drawing Sheets

BUZZ SUPPRESSION IN BURNERS OF HIGH CAPACITY DIRECT FIRED FLUID HEATERS

BACKGROUND OF THE INVENTION

1. Field of the Invention

This invention relates to burner heaters where a fluid fuel is continuously injected and burned in a combustion chamber and the hot combustion gases are passed through a heat exchanger for heating a fluid. More particularly, the invention is directed to various devices and methods for controlling and suppressing in certain of such burners the onset of an undesirable acoustical phenomenon, referred to as buzzing in this disclosure.

2. State of the Prior Art

Direct fired heaters have long been used in such applications as aircraft deicers for heating large quantities of deicing solution, for rapidly vaporizing liquid nitrogen in industrial installations and oil wells, and for heating water.

This applicant has developed heaters of this type which are characterized by compact burner size, as measured by volume of the combustion chamber, in relation to the BTU capacity of the burner, typically several million BTU/Hour and ranging as high as 12 million BTU/Hour, at heat rates of 1 to 2 million BTU/-Hour/Cubic Ft.. The high BTU capacity in these burners is the result of a swirling of the air input to the burner. This creates intense mixing within the combustion flame. This is in contrast to the burner designs of other manufacturers where the flame follows a generally straight path towards the discharge end of the combustion chamber, resulting in less intense combustion so that less fuel can be burned for a given combustion chamber volume.

The general configuration of applicant's direct fired heaters is disclosed in U.S. Pat. Nos. 4,373,896 and 4,374,637. It includes an inner barrel combustion chamber with a fuel block at a closed end of the barrel, an outer barrel coaxially surrounding the inner barrel and defining an annular space between the two barrels, and a blower mounted for driving a stream of air through this annular space and into the inner barrel through inlet openings in the back wall and in the cylindrical wall of the combustion chamber. The closed end of the combustion chamber is normally squared, i.e., it is closed by a generally planar back wall perpendicular to the barrel axis. The fuel block is centered in the back wall and includes a number of fuel injectors which spray finely dispersed fuel towards the periphery of the chamber, and an ignition unit which is typically a spark plug for initiating combustion of the fuel. The back wall has air inlets and swirling vanes which direct the inlet air stream such that the flame produced by the burning air-fuel mixture follows a generally helicoidal path bout the barrel axis and against the cylindrical wall of the chamber as it travels towards the opposite, open end of the chamber. Bypass holes are formed on the cylindrical wall of the inner barrel downstream of the backwall to admit additional air from the air stream flowing in the annular space between the two barrels in order to reduce discharge temperature. The outer barrel is closed at both ends and there is an exhaust stack for venting the combustion gases to the atmosphere. The exhaust stack may be at a right angle to the axis of the two barrels. Combustion gases flow through a heat exchanger for heating a fluid medium circulating through the heat exchanger interposed between the open end of the combustion chamber and the exhaust stack.

Under some operating conditions, particularly when burning gaseous or highly volatile liquid fuels such as gasoline, an undesirable acoustically coupled combustion instability can arise. This acoustically coupled combustion instability called buzzing can generate intense sounds which may be unacceptable in many applications. This applicant is not aware of existing solutions for controlling the onset of buzzing in burners of the aforedescribed type. A solution to this problem is needed.

SUMMARY OF THE INVENTION

The present disclosure provides an approach or technique which has been found effective in combatting incidence of buzzing in this applicant's burners.

In this invention, means were fitted to the discharge end of the exhaust stack for restricting the discharge opening of the exhaust stack. The area restricting element may consist of a slotted or perforated metal plate placed over the discharge opening of the exhaust stack, the plate having a total aperture considerably smaller than the discharge aperture so as to significantly restrict the area of the exhaust stack opening. For example, the total open aperture of the slotted or perforated plate may be about one half the unrestricted discharge aperture of the exhaust stack. In one form of the invention, a variable restricting unit is adjustable for varying the area of the restriction to facilitate elimination of buzzing while minimizing the back pressure.

These and other features and advantages of the present invention will be better understood by reference to the following detailed description of the preferred embodiments taken with reference to the accompanying drawings.

DETAILED DESCRIPTION OF THE PREFERRED EMBODIMENTS

A. General Configuration of the Direct Fired Heaters

Figure 1:
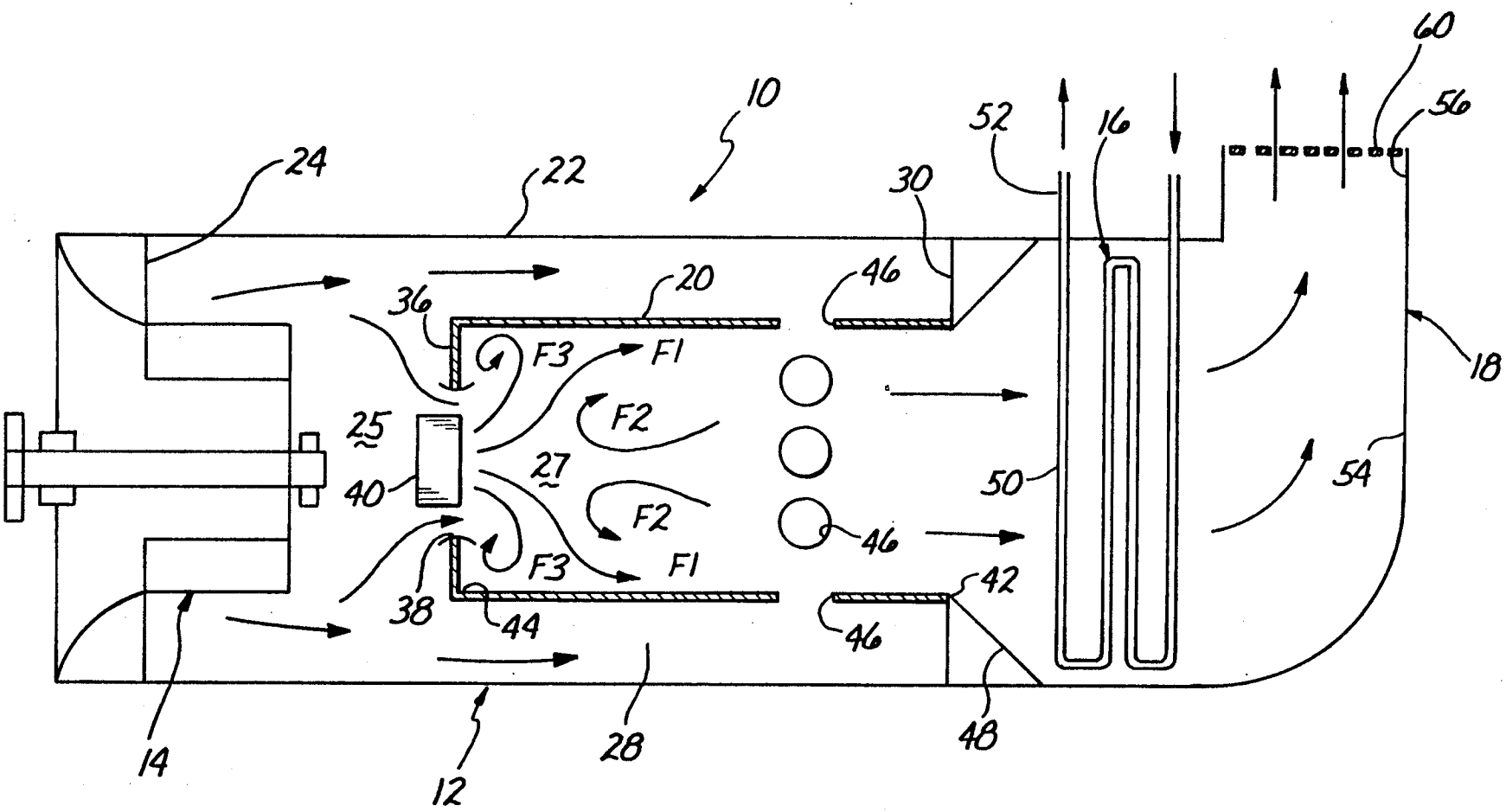
FIG. 1 is a longitudinal cross-section of applicant's heater fitted with a restrictor on the exhaust stack for control of buzzing.

The general design of this applicant's heaters is shown in simplified form in FIG. 1 where a heater 10 has a burner 12, a blower 14 mounted to one end of the burner, a heat exchanger 16 at the opposite end of the burner, and an exhaust stack 18 downstream of the heat exchanger.

The burner 12 includes two cylindrical barrels, an inner barrel 20 coaxially enclosed within a substantially larger outer barrel 22. Outer barrel 22 has a closed end 24, and the inner barrel has a closed end 36. The blower 14 is mounted at the closed end of the outer barrel with a head space 25 between the end of the blower and the closed end of the combustion chamber. An annular longitudinal space 28 extends between the cylindrical side walls of the two barrels and is closed at a downstream end by a baffle 30. The interior of the inner barrel 20 defines a combustion chamber 27 closed with a back wall 36 and an opposite open end 42 centered in the end baffle 30. An air inlet 38 centered in the back wall 36 admits air forced into head space 25 by blower 14. A fuel block 40 is mounted in the center of air inlet 38. Fuel block 40 includes a number of fuel injectors (not shown in the drawings) which are connected to a supply of combustible fuel by appropriate conduits and are driven as by pressurized air for spraying finely divided droplets of liquid fuel into the combustion chamber 27. The inner barrel 20 also includes an ignition source such as a spark plug (not shown) positioned and powered for igniting the fuel spray. The air inlet 38 includes swirling vanes which direct the incoming air generally tangentially to the cylindrical wall 20 of the combustion chamber, imparting a swirling motion to the intense flame produced by the ignited mixture of fuel and air. The pattern of combustion and heat release in the chamber 27 includes an intense radial swirling outflow F1 along the axis of the chamber. This outflow acts as a flame holding region causing a recirculation of burned combustion products indicated by arrows F2 inwardly along the axis of the chamber and back towards the head of the chamber 27 where they mix with the incoming fuel and air. The intense radial outflow caused by the swirling motion F1 also produces a flow separation pattern at the head of the chamber, setting up rotating vortex indicated by arrows F3 from the inlet 38 towards the annular corner 44 defined at the intersection of the back wall 36 and cylindrical side wall 20. This rotating vortex F3 also acts as a flame holding region where the products of combustion rotate back into the incoming separated vortex flow.

About one third of the air driven by blower 14 enters the combustion chamber 27 through inlet 38. The remainder of the blower flow moves over the closed back end of the inner barrel and into annular space 28 to cool the head end of the inner barrel 20, and enters the combustion chamber 27 downstream of the primary combustion zone through bypass holes 46 spaced in a circular pattern encompassing the inner barrel 20, where it mixes with the combustion products and reduces somewhat the high temperature of the gas stream ahead of the heat exchanger 16. The hot gas flow then passes through a transition 48 which connects the open end 42 of the combustion chamber to the inlet side 50 of the heat exchanger, and into heat exchanging contact with conduits 52 through which circulates a fluid to be heated for the particular application of the heater unit 10, such as heating deicing solution in the case of a deicer unit. The gas stream discharges from the heat exchanger 16 into exhaust stack 18 which includes an end wall 54 and a side discharge aperture 56, forcing the exhaust gases through a 90 degree change in flow direction to direct the exhaust stream upwardly into the ambient atmosphere and away from surrounding personnel or equipment.

The general burner design just described can vary in size, type of fuel e.g. gasoline, DF2 or natural gas, and type of blower e.g. centrifugal cage, axial vane or mixed-flow types.

B. The Buzzing Phenomenon

The undesirable acoustic phenomenon referred to as "buzzing" by this applicant is a sustained, deep, low frequency rumble and vibration in the burner which has been found to occur under certain not entirely predictable circumstances, and which can vary in intensity from a minor annoyance to a very loud roar.

For a particular burner, buzzing may appear at a given rate of fuel or air flow into the burner, and adjustments to either flow may suppress the problem. The problem appears to be more strongly associated with the use of centrifugal fan type blowers, whereas the use of axial vane blowers appears to generally alleviate the incidence of buzzing. Mixed flow blowers, a combination of centrifugal and axial vane configurations, are more likely to bring about buzzing in the burner than axial vane blowers. Onset of buzzing is also affected by the type of fuel used, whether natural gas, DF2 (Diesel Fuel), or gasoline. A given burner configuration may buzz when operated with one of these fuels but not with another. It has been found that changes in the swirl vanes at the air inlet 38 or in the arrangement of bypass holes 46 can affect the onset of buzz. These adjustments change the distribution of heat release in the combustion chamber 27, but the actual nature of the buzzing effect remains undetermined. Changing from one type of fuel, e.g from gasoline to DF2, may also stop the buzzing for a given burner configuration.

A heater 10 was constructed as in FIG. 1 with a very large burner and heat exchanger fueled by natural gas, with an inner barrel 20 diameter of approximately 36 inches and an outer barrel 22 diameter of approximately 46 inches, and a capacity of 12 million BTU/Hour for heating high temperature water in an atomic power generating test facility. It was found in this heater that the burner 12 buzzed when the combustion temperature was raised. It was also found that buzzing in the burner was affected by the configuration of the exhaust passage through which combustion gases flowed from the combustion chamber 27. When the burner 12 was operated with the end of the combustion chamber open to the atmosphere in an early stage of assembly, no buzzing was found to occur. A screen across the chamber opening to simulate the back pressure of the heat exchanger and the exhaust stack was then added and still no buzz occurred. In a subsequent stage of assembly and testing, the heat exchanger 16 was installed at the downstream end of the combustion chamber, and the unit again tested. Once again it was found that no buzzing occurred, although the flow of exhaust gas from the combustion chamber was significantly restricted by the heat exchanger. In a further stage of assembly, the outer barrel was closed at the downstream end by assembly of the exhaust stack 18 to the heater so that the exhaust gases vented to the atmosphere through the exhaust stack. As shown in FIG. 1, the exhaust stack extends at a right angle to the axis of the combustion chamber 27, further restricting gas flow out of the combustion chamber. Unacceptable buzzing was found to occur. Tests were then conducted to determine the effect of varying degrees of restriction on the aperture of the exhaust stack discharge opening 56 and its relationship to the onset of buzzing in the burner. The discharge opening 56 of the exhaust stack was blocked or restricted to varying degrees, by placing plates with varying ratios of aperture area to plate area over the discharge opening 56 of the exhaust stack. Surprisingly, it was found that sheet metal plates blocking approximately 50% of the discharge opening of the exhaust stack eliminated the buzzing.

Figure 2:
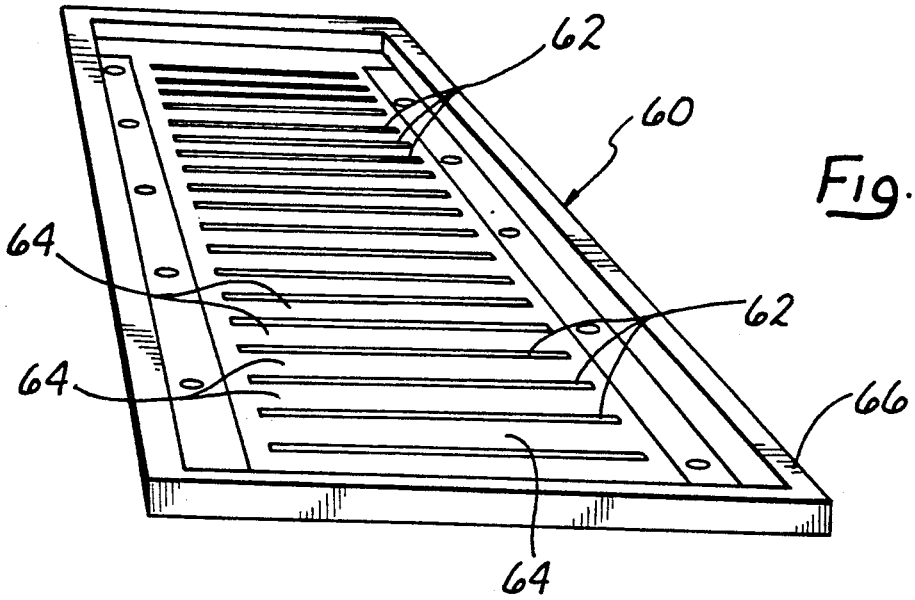
FIG. 2 is a perspective of a fixed aperture slotted plate restrictor for the exhaust stack in FIG. 1.

A solution to the buzzing problem was therefore implemented by attaching a slotted sheet metal plate 60 to the exhaust opening 56. As shown in FIG. 2, the plate 60 defines a grille with a total combined aperture of the openings 62 between the metal strips 64 of approximately 50% of the overall area of the plate enclosed by the four edges of the plate. The plate 60 has an outer frame 66 which fits onto the edges of the discharge opening 56 of the exhaust stack 18. The plate 60 was found to suppress the buzzing in the burner 12.

Figure 3:
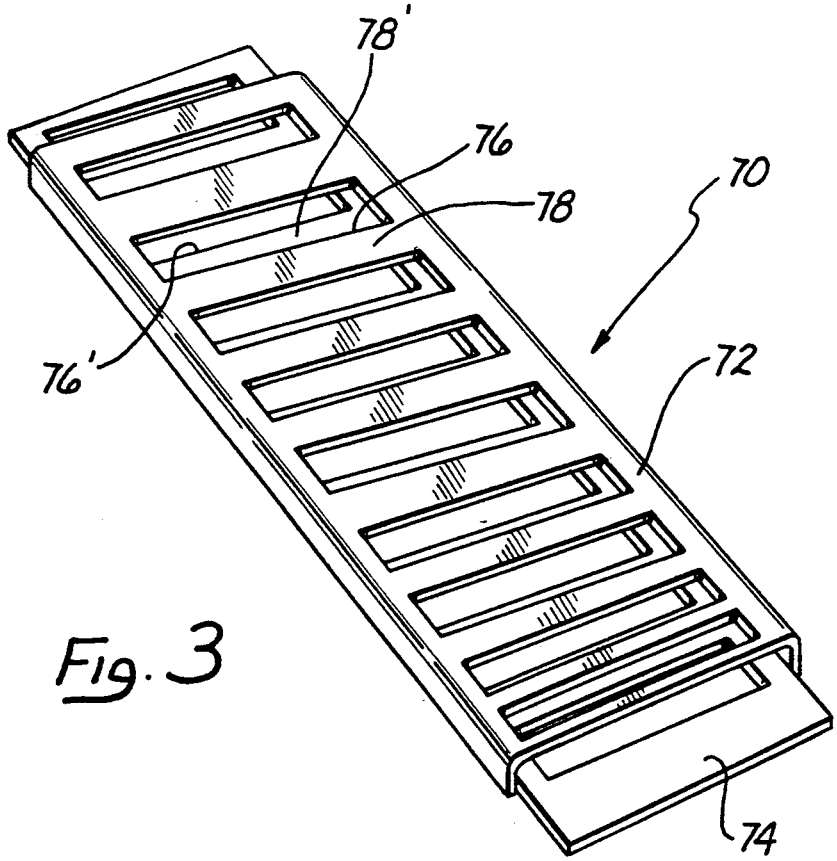
FIG. 3 is a perspective of a variable aperture slotted plate restrictor for the exhaust stack in FIG. 1.

The use of such aperture restrictor plates 60 on the exhaust stack was found to be an effective solution to the buzzing problem in a number of different direct fired fluid burner heater units 10 of the type described above. In one form of this invention, illustrated in FIG. 3, an aperture restrictor 70 consisted of two sheet metal plates 72, 74 each with slots 76 between metal strips 78 placed together and slidable longitudinally one against the other so as to achieve a variable aperture effect of the combined plates when mounted over the discharge aperture of the exhaust stack. In FIG. 3 the identifying numerals of the slots 76 and strips 78 of the lower plate 74 are primed. Thus, the effective area of the discharge aperture of stack 18 can thus be adjusted to eliminate the buzzing with the least degree of restriction of the exhaust flow and back pressure on the gas flow from the combustion chamber 27. In another embodiment of the invention, a perforated sheet metal plate was used to restrict the area of the discharge opening 56 of the stack 18. The perforated plate had approximately 40 to 50% open area and was found to suppress the buzzing in the heater to which it was applied.

While a particular embodiment of the invention has been described and illustrated for purposes of clarity and example, it will be understood that many changes, substitutions and modifications to the described embodiment will be apparent to those possessed of ordinary skill in the art without thereby departing from the scope and spirit of the present invention, which is defined by the following claims.

What is claimed is:

1. A direct fired burner suitable for use with either high volatility fuels including natural gas and gasoline or low volatility fuels including #2 Diesel fuel and featuring burner buzz control, comprising:

a combustion chamber defined by an inner barrel having a closed end and an opposite open end, an outer barrel containing said inner barrel and defining an annular space therebetween, blower means at one end of said outer barrel for driving a stream of air into said combustion chamber through inlet means in said closed end, fuel injection means, fuel ignition means and swirl inducing means at said closed end for sustaining a combustion flame in said combustion chamber, an exhaust stack for exhausting combustion gases from said inner barrel to the atmosphere, a heat exchanger interposed between said open end of the inner barrel and said exhaust stack downstream of said combustion flame, and means fitted to a discharge opening of said stack away from contact with said combustion flame for partially restricting the aperture of said discharge opening of said exhaust stack whereby buzzing is suppressed within said combustion chamber upstream of said heat exchanger.

2. The heater of claim 1 wherein said aperture restricting means comprise a slotted plate placed over said discharge opening of said exhaust stack, said slotted plate having a total aperture substantially smaller than said discharge opening.

3. The hater of claim 2 wherein said total aperture of the slotted plate is about one half that of said discharge aperture.

4. The heater of claim 1 wherein said aperture restricting means comprise a perforated plate placed over said discharge opening of said exhaust stack, said perforated plate having a total aperture substantially smaller than said discharge opening.

5. The heater of claim 3 wherein said total aperture of the slotted plate is about one half that of said discharge aperture.

6. The heater of claim 1 wherein said restricting means are adjustable for varying the area of said discharge opening thereby to facilitate elimination of buzzing of said burner while minimizing back pressure.

7. A method for controlling buzz in a direct fired fluid burner heater of the type having a combustion chamber defined by an inner barrel having a closed end and an opposite open end, an outer barrel containing said inner barrel and defining an annular space therebetween, blow means at one end of said outer barrel for driving a stream of air into said combustion chamber through inlet means in said closed end, fuel injection means, fuel ignition means and swirl inducing means at said closed end for sustaining a combustion flame in said combustion chamber, an exhaust stack communicating said outer barrel for exhausting combustion gases from said inner barrel to the atmosphere, said stack terminating in a discharge aperture, a heat exchanger interposed between said open end of the inner barrel and said exhaust stack downstream of said combustion flame, said method comprising the steps of:

providing discharge aperture restricting means; and fitting said restricting means to said discharge opening of said stack away from contact with said combustion flame for suppressing buzz within said burner.

8. The method of claim 7 wherein said step of providing comprises the step of providing a perforated plate having a total aperture substantially smaller than the discharge aperture of the exhaust stack, and said step of fitting comprises the step of placing said plate over said discharge aperture.

9. The method of claim 7 wherein said step of providing comprises the step of providing a slotted plate having a total aperture substantially smaller than the discharge aperture of the exhaust stack, and said step of fitting comprises the step of placing said plate over said discharge aperture.

10. The heater of claim 8 wherein said perforated plate is selected to have a total aperture of about one half of said discharge aperture.

11. The heater of claim 9 wherein said slotted plate is selected to have a total aperture of about one half of said discharge aperture.

12. The heater of claim 7 wherein said fitting step includes the step of adjusting said flow restricting means to minimize or eliminate buzzing of said burner while minimizing back pressure.

13. A direct fired burner suitable for use with either high volatility fuels including natural gas and gasoline or low volatility fuels including #2 Diesel fuel and featuring burner buzz control, comprising:

a combustion chamber defined by an inner barrel having a closed end and an opposite open end, an outer barrel containing said inner barrel and defining an annular space therebetween, blower means at one end of said outer barrel for driving a stream of air into said combustion chamber through inlet means in said closed end, fuel injection means, fuel ignition means and swirl inducing means at said closed end for sustaining a combustion flame in said combustion chamber, an exhaust stack for exhausting combustion gases from said inner barrel to the atmosphere, and means fitted to a discharge opening of said stack away from contact with said combustion flame for partially restricting the aperture of said discharge opening of said exhaust stack whereby buzzing is suppressed within said combustion chamber.

14. The burner of claim 13 wherein said flow restricting means include openings defined therein and distributed throughout said discharge aperture.

15. The burner of claim 13 wherein said openings together comprise a total aperture area of said flow restricting means equal to or greater than about one half of said discharge aperture.

* * * * *